US009446499B2

(12) United States Patent
Ono et al.

(10) Patent No.: US 9,446,499 B2
(45) Date of Patent: Sep. 20, 2016

(54) GRINDING WHEEL TRUING METHOD AND GRINDING MACHINE

(71) Applicant: JTEKT CORPORATION, Osaka-shi (JP)

(72) Inventors: Naoto Ono, Anjo (JP); Satoshi Okubo, Anjo (JP); Toshiki Sakai, Kariya (JP)

(73) Assignee: JTEKT CORPORATION, Osaka-shi (JP)

( * ) Notice: Subject to any disclaimer, the term of this patent is extended or adjusted under 35 U.S.C. 154(b) by 14 days.

(21) Appl. No.: 14/657,392

(22) Filed: Mar. 13, 2015

(65) Prior Publication Data

US 2015/0258659 A1 Sep. 17, 2015

(30) Foreign Application Priority Data

Mar. 17, 2014 (JP) ..... 2014-052927

(51) Int. Cl.

| | |
|---|---|
| ***B24B 53/00*** | (2006.01) |
| ***B24B 53/04*** | (2012.01) |
| ***B24B 53/06*** | (2006.01) |
| ***B24B 53/14*** | (2006.01) |
| ***B24B 5/04*** | (2006.01) |

(52) U.S. Cl.

CPC ..... *B24B 53/04* (2013.01); *B24B 5/04* (2013.01); *B24B 53/062* (2013.01); *B24B 53/14* (2013.01)

(58) Field of Classification Search

CPC ..... B24B 53/04; B24B 5/04; B24B 53/062; B24B 53/14; B24B 49/18; B24B 49/183; B24B 53/017; B24B 5/06; B24B 37/04; B24B 37/042; B24B 57/02

USPC ..... 451/5, 21, 56, 443

See application file for complete search history.

(56) References Cited

U.S. PATENT DOCUMENTS

| | | | | |
|---|---|---|---|---|
| 1,995,304 | A * | 3/1935 | Hallam | B24B 53/07 125/11.03 |
| 5,045,664 | A * | 9/1991 | Nakagawa | B23H 1/00 219/69.15 |
| 5,595,528 | A * | 1/1997 | Becker | B24B 49/14 125/11.03 |
| 7,797,074 | B2 * | 9/2010 | Hyatt | B23B 3/168 700/164 |
| 2014/0335769 | A1 | 11/2014 | Sakai et al. | |

FOREIGN PATENT DOCUMENTS

| | | |
|---|---|---|
| EP | 2 801 441 A1 | 11/2014 |
| GB | 519081 A | 3/1940 |
| JP | 2009-285776 | 12/2009 |

OTHER PUBLICATIONS

Extended European Search Report issued Jul. 22, 2015 in Patent Application No. 15158986.8.

* cited by examiner

*Primary Examiner* — George Nguyen

(74) *Attorney, Agent, or Firm* — Oblon, McClelland, Maier & Neustadt, L.L.P.

(57) ABSTRACT

A truing device is supported so as to be elastically movable in the Z-axis direction, which is parallel to a grinding wheel rotational axis, and elastically movable in the X-axis direction in which a grinding wheel cuts into the truing device, and includes a movement restriction device that controls prohibition and permission of elastic movement. The method includes: causing a surface of the grinding wheel to contact the truing device in the X-axis direction; and correcting a shape of the grinding wheel when the grinding wheel cuts into the truing device until the amount of elastic movement of the truing device in the X-axis direction reaches a first predetermined amount, by controlling the movement restriction device to prohibit elastic movement of the truing device, and thereafter causing the grinding wheel to further cut into the truing device in the X-axis direction by a second predetermined amount.

4 Claims, 10 Drawing Sheets

[IN CASE WHERE FIRST PREDETERMINED AMOUNT IS NOT ZERO]

(GRINDING WHEEL SHAPE CORRECTION STEP)

(GRINDING WHEEL SURFACE ROUGHNESS CORRECTION STEP)

[IN CASE WHERE FIRST PREDETERMINED AMOUNT IS SUBSTANTIALLY ZERO]

GRINDING WHEEL TRUING METHOD AND GRINDING MACHINE

INCORPORATION BY REFERENCE

The disclosure of Japanese Patent Application No. 2014-052927 filed on Mar. 17, 2014 including the specification, drawings and abstract, is incorporated herein by reference in its entirety.

BACKGROUND OF THE INVENTION

1. Field of the Invention

The present invention relates to a grinding wheel truing method and a grinding machine.

2. Description of Related Art

In a common grinding machine according to the related art, a truing surface, that is, a surface for reshaping a grinding wheel, of a truer is fixed in position with respect to the grinding machine. Thus, in the case where there is an error in position of a surface to be processed of the grinding wheel in the X-axis direction (a direction in which the grinding wheel cuts into a workpiece and which is orthogonal to the grinding wheel rotational axis) and in position thereof in the Z-axis direction (a direction that is parallel to the grinding wheel rotational axis) due to thermal displacement of the grinding machine or the like, it is necessary to detect the accurate position of the surface to be processed of the grinding wheel in the X-axis direction and the accurate position thereof in the Z-axis direction in order to execute truing of the grinding wheel using the truer. To this end, the grinding machine is provided with an X-axis direction detection pin and a Z-axis direction detection pin, and the grinding wheel is moved finely in the X-axis direction and the Z-axis direction so that the surface to be processed of the grinding wheel contacts the X-axis direction detection pin and the Z-axis direction detection pin in order to accurately detect the position of the surface to be processed of the grinding wheel in the X-axis direction and the position thereof in the Z-axis direction.

Japanese Patent Application Publication No. 2009-285776 (JP 2009-285776 A) describes a grinding device in which at least one of a wheel spindle that supports and rotates a grinding wheel and a dressing spindle that supports and rotates a dresser is supported by a controllable axial magnetic bearing and a controllable radial magnetic bearing that support the spindle in a non-contact manner at a predetermined target levitated position in the axial direction and the radial direction. In this configuration, when a surface to be processed of the grinding wheel is caused to contact a dressing surface of the dresser, the amount of deviation of the dresser or the grinding wheel in the axial direction is detected from variations in value of a control current for the controllable axial magnetic bearing, and the target levitated position of the controllable axial magnetic bearing in the axial direction is changed in accordance with the detected deviation amount to cause the position of the surface to be processed of the grinding wheel in the axial direction to coincide with the position of the dressing surface of the dresser.

In the grinding machine according to the related art in which the position of the surface of the grinding wheel in the X-axis direction and the position thereof in the Z-axis direction are detected using the X-axis direction detection pin and the Z-axis direction detection pin, the position at which the X-axis direction detection pin and the Z-axis direction detection pin contact the surface of the grinding wheel is detected while the grinding wheel is finely moved. Thus, it takes a significantly long time to detect the position of the surface of the grinding wheel, which degrades the efficiency of truing.

In the grinding device described in JP 2009-285776 A, meanwhile, at least one of the wheel spindle and the dressing spindle is constituted by the controllable axial magnetic bearing and the controllable radial magnetic bearing described above, which significantly complicates the structure of the device and increases the size of the device.

SUMMARY OF THE INVENTION

The present invention has been made in view of such issues, and therefore has an object to provide a grinding wheel truing method and a grinding machine with a simple structure and capable of truing a grinding wheel efficiently in a short time and avoiding an increase in size of the device.

According to an aspect of the present invention, a grinding wheel truing method comprises:

(a) by a control device, causing a surface of a grinding wheel to contact a truing device by moving the grinding wheel with respect to the truing device in a Z-axis direction to cause the truing device and the grinding wheel to face each other in a X-axis direction, and then controlling a movement restriction device to a permitted state so as to relatively move the grinding wheel with respect to the truing device in the X-axis direction; and (b) by the control device, correcting a shape of the grinding wheel, when the grinding wheel and the truing device contact each other, or when the grinding wheel relatively cuts into the truing device in the X-axis direction until an amount of elastic movement of the truing device in a X-axis direction reaches a first predetermined amount after the grinding wheel and the truing device contact each other, by controlling the movement restriction device to a prohibited state so as to prohibit elastic movement of the truing device in at least the X-axis direction, and thereafter causing the grinding wheel to further relatively cut into the truing device in the X-axis direction by a second predetermined amount, wherein, the grinding wheel truing method is performed using:

the grinding wheel having a generally cylindrical shape and driven to rotate about a grinding wheel rotational axis;

the truing device supported so as to be rotatable about a truer rotational axis that is parallel to the Z-axis direction that is parallel to the grinding wheel rotational axis, or supported so as to be driven to rotate about the truer rotational axis, to execute truing of the grinding wheel; and the control device that relatively moves the grinding wheel with respect to the truing device in the X-axis direction and the Z-axis direction, the X-axis direction being a direction that is orthogonal to the grinding wheel rotational axis and in which the grinding wheel cuts into the truing device, the truing device being elastically supported in the Z-axis direction to be elastically movable in the Z-axis direction, being elastically supported in the X-axis direction to be elastically movable in the X-axis direction, and including a movement restriction device that controls prohibition and permission of elastic movement in at least the X-axis direction, According to the above mentioned aspect, the truing device is elastically supported in the X-axis direction and the Z-axis direction. Thus, in the case where the surface to be processed of the grinding wheel is caused to contact the truing device, the truing device that is elastically supported is automatically and elastically moved toward the grinding wheel even if there is a deviation between the position of the surface of the grinding wheel and the position of the truing device. Thus, it is possible to avoid an increase in size of the device with a simple configuration in which the truing device is elastically supported. There is no need to detect the accurate position of the grinding wheel in the X-axis direction or the accurate position of the grinding wheel in the Z-axis direction, and truing can be performed in a significantly short time. The provision of the movement restriction device allows the grinding wheel to be appropriately trued into a perfect circle shape by prohibiting elastic movement in the X-axis direction using the movement restriction device even in the case where the grinding wheel has run-out in the peripheral shape and does not have a perfect circle shape.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

An embodiment of the present invention will be described below with reference to the drawings. In drawings in which the X axis, the Y axis, and the Z axis are indicated, the X axis, the Y axis, and the Z axis are orthogonal to each other. The Y-axis direction indicates the vertically upward direction. The Z-axis direction indicates a direction that is parallel to a grinding wheel rotational axis L1. The X-axis direction indicates a direction which is orthogonal to the grinding wheel rotational axis L1 and in which a grinding wheel 32 cuts into a workpiece W. The grinding wheel rotational axis L1, a workpiece rotational axis L2, and a truer rotational axis L3 are all parallel to the Z-axis direction.

Figure 1:
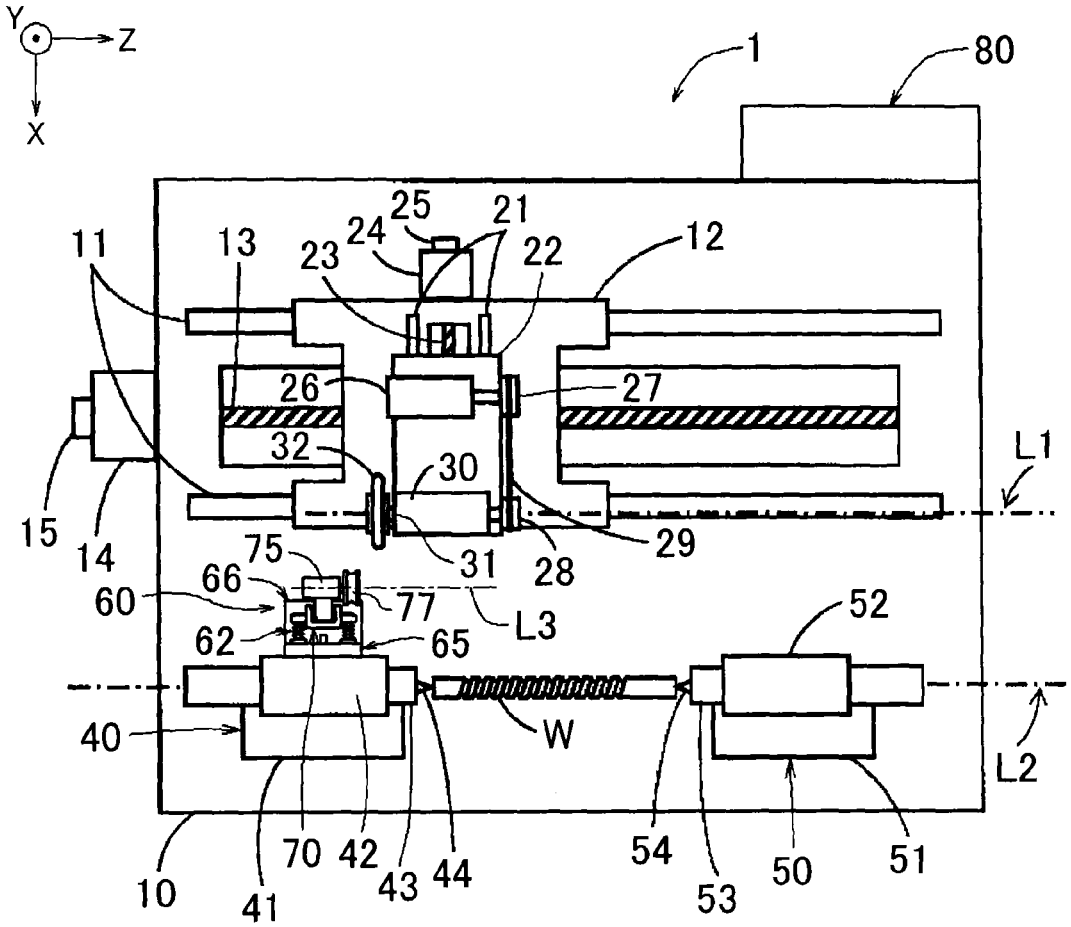
FIG. 1 is a plan view illustrating an overall configuration of a grinding machine according to an embodiment of the present invention.
Figure 2:
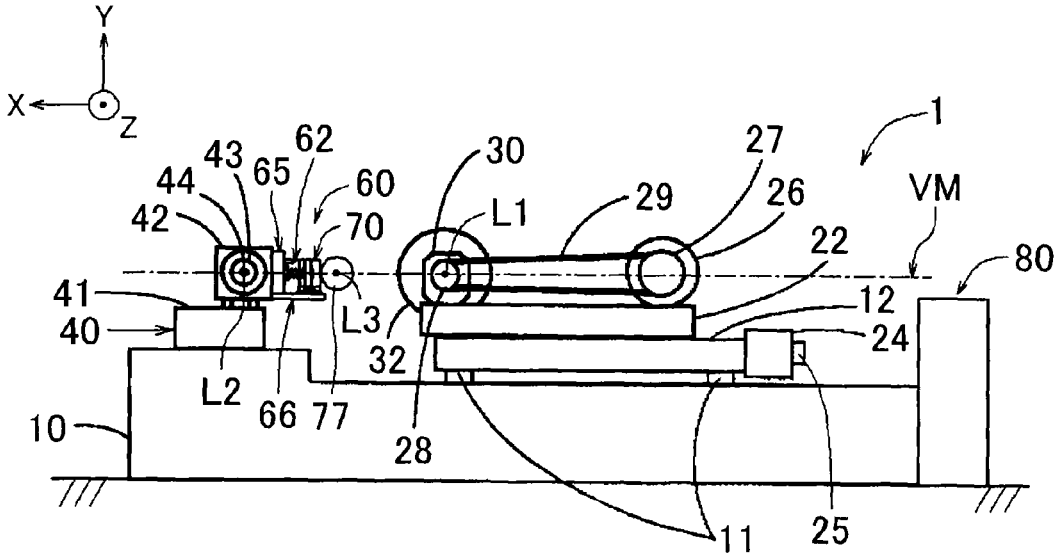
FIG. 2 is a side view of the grinding machine illustrated in FIG. 1.

FIGS. 1 and 2 illustrate an overall configuration of a grinding machine 1. As illustrated in FIGS. 1 and 2, the grinding machine 1 is configured such that relative movement of the grinding wheel 32 with respect to the workpiece W in the X-axis direction and the Z-axis direction is controlled so as to grind the workpiece W. A Z-axis direction slide table 12 is installed on a generally center portion of a platform 10 formed in a rectangular shape in a plan view. The Z-axis direction slide table 12 is guided by a pair of Z-axis direction guide rails 11 extending in the Z-axis direction to slide. The Z-axis direction slide table 12 is slid in the Z-axis direction by rotational motion of a Z-axis direction feed screw 13 driven by a Z-axis direction driving motor 14 (which corresponds to the Z-axis direction movement device). The Z-axis direction driving motor 14 is controlled by a control device 80 (such as an NC control device). In addition, the Z-axis direction driving motor 14 is provided with a Z-axis direction position detector 15 (which corresponds to the Z-axis relative movement amount detector) such as a rotary encoder that detects the rotational angle of an output shaft of the Z-axis direction driving motor 14 and sends a detection signal to the control device in order to check the position of the Z-axis direction slide table 12 in the Z-axis direction. The control device 80 relatively moves the grinding wheel 32 with respect to a truer 77 in the Z-axis direction using the Z-axis direction driving motor 14, and can detect the amount of relative movement of the grinding wheel 32 with respect to the truer 77 in the Z-axis direction on the basis of the detection signal from the Z-axis direction position detector 15.

An X-axis direction slide table (grinding wheel slide table) 22 is installed on the Z-axis direction slide table 12. The X-axis direction slide table 22 is guided by a pair of X-axis direction guide rails 21 extending in the X-axis direction to slide. The X-axis direction slide table 22 is slid in the X-axis direction by rotational motion of an X-axis direction feed screw 23 driven by an X-axis direction driving motor 24 (which corresponds to the X-axis direction movement device). The X-axis direction driving motor 24 is controlled by the control device 80. In addition, the X-axis direction driving motor 24 is provided with an X-axis direction position detector 25 (which corresponds to the X-axis relative movement amount detector) such as a rotary encoder that detects the rotational angle of an output shaft of the X-axis direction driving motor 24 and sends a detection signal to the control device in order to check the position of the X-axis direction slide table 22 in the X-axis direction. The control device 80 relatively moves the grinding wheel 32 with respect to the truer 77 in the X-axis direction using the X-axis direction driving motor 24, and can detect the amount of relative movement of the grinding wheel 32 with respect to the truer 77 in the X-axis direction on the basis of the detection signal from the X-axis direction position detector 25.

A grinding wheel driving motor 26 and a wheel spindle holder 30 are installed on the X-axis direction slide table 22. A driving pulley 27 is provided on an output shaft of the grinding wheel driving motor 26. A wheel spindle 31 is rotatably supported by the wheel spindle holder 30 to rotate about the grinding wheel rotational axis L1 which is parallel to the Z-axis direction. A grinding wheel 32 in a generally cylindrical shape is attached to a first end portion of the wheel spindle 31. A driven pulley 28 is provided at a second end portion of the wheel spindle 31. A belt 29 is stretched between the driving pulley 27 and the driven pulley 28. This allows torque of the output shaft of the grinding wheel driving motor 26 to be transferred to the wheel spindle 31 via the belt 29.

A first main spindle device 40 and a second main spindle device 50 that hold a workpiece W in a shaft shape are installed on the platform 10 and on the workpiece rotational axis L2. The first main spindle device 40 and the second main spindle device 50 hold the workpiece W in position while rotating the workpiece W about the workpiece rotational axis L2 which is parallel to the Z axis. The first main spindle device 40 includes a headstock 41 fixed on the platform 10, a main spindle housing 42 that is reciprocally movable with respect to the headstock 41 in the direction of the workpiece rotational axis L2, and a main spindle 43 supported in the main spindle housing 42 so as to be rotatable about the workpiece rotational axis L2. A center member 44 is provided at the distal end of the main spindle 43 to support the center portion of one end surface of the workpiece W. The main spindle 43 is driven by a main spindle motor (not illustrated) controlled by the control device 80, and controlled so as to rotate to a desired angle at a desired angular velocity. As with the first main spindle device 40, the second main spindle device 50 also includes a headstock 51, a main spindle housing 52, a main spindle 53, and a center member 54. The main spindle housing 42 is provided with a truing device 60 including the truer 77 supported so as to be rotatable about the truer rotational axis L3. As illustrated in FIG. 2, the grinding wheel rotational axis L1, the workpiece rotational axis L2, and the truer rotational axis L3 are all on a virtual plane VM which is parallel to the X-axis direction and the Z-axis direction.

Figure 3:
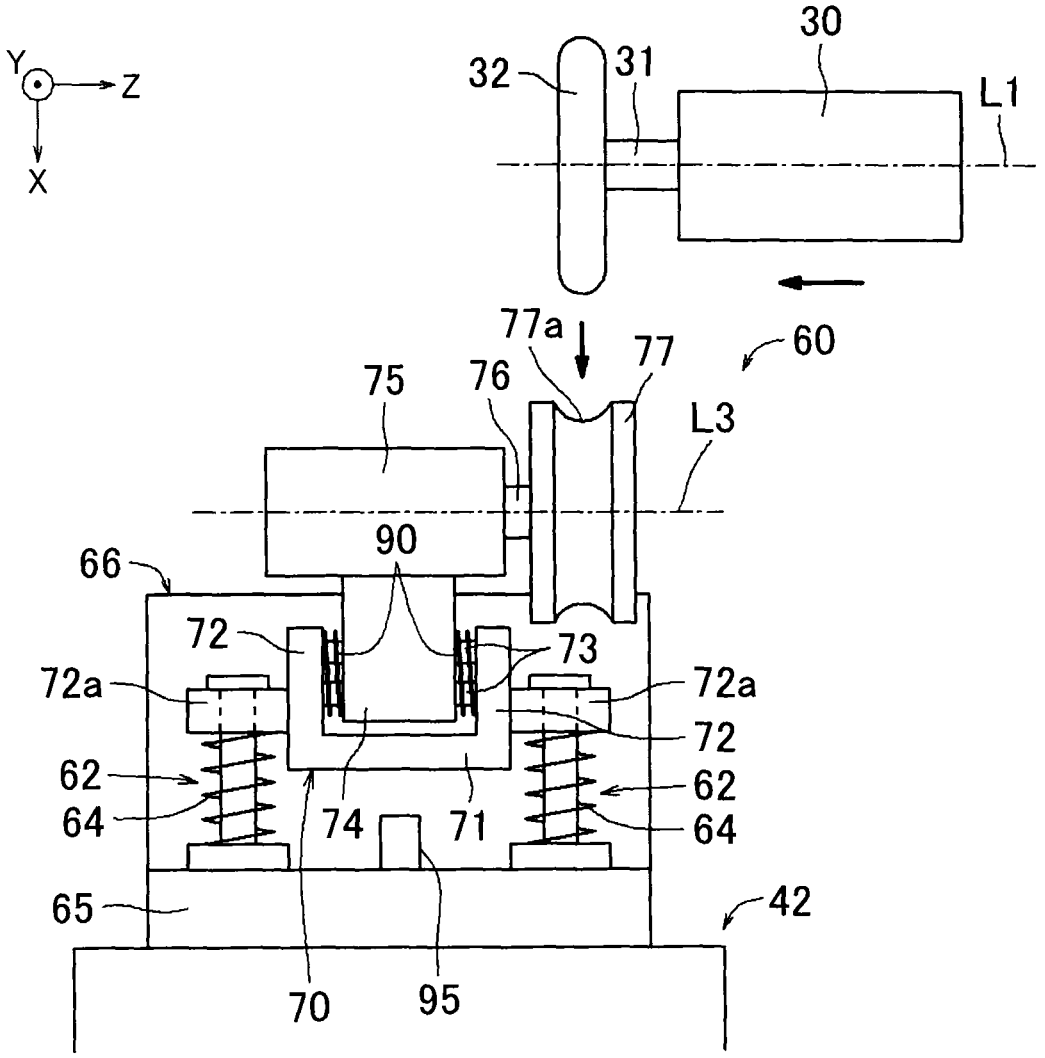
FIG. 3 is a plan view of a truing device and a grinding wheel, illustrating a state in which a truer and the grinding wheel are spaced from each other in the X-axis direction.
Figure 4:
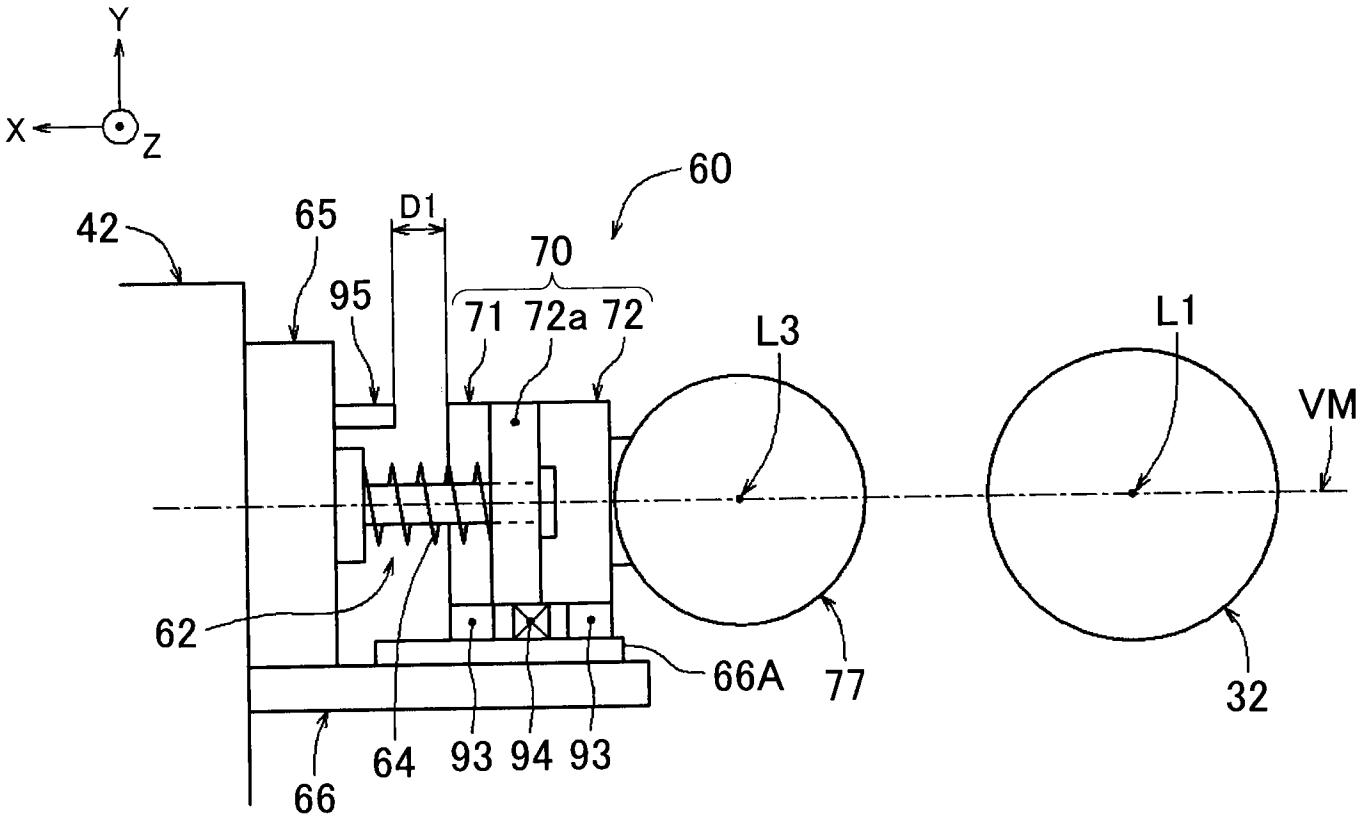
FIG. 4 is a side view of the state illustrated in FIG. 3.

Next, the configuration of the truing device 60 and the truing state of the grinding wheel 32 will be described with reference to FIGS. 3 to 6. As illustrated in FIGS. 3 and 4, the truing device 60 includes base members 65 and 66, a movable stage 70, an X-axis direction elastic support mechanism 62, a Z-axis direction slide body 74, a Z-axis direction elastic support mechanism 73, a truing spindle holder 75, a truing spindle 76, a truer 77, a linear motion guide 93, a movement restriction device 94, an X-axis elastic movement amount detector 95, and so forth.

The base members 65 and 66 are fixed to the main spindle housing 42 of the first main spindle device 40. The linear motion guide 93 is attached to a surface of the movable stage 70 that faces the base member 66. The movable stage 70 is reciprocally slidable in the X-axis direction along a guide rail 66A provided on the base member 66. The movable stage 70 includes a base portion 71 that extends in the Z-axis direction and the Y-axis direction, and both side wall portions 72 that project in the X-axis direction from both end portions of the base portion 71 in the Z-axis direction. The base portion 71 and the both side wall portions 72 are formed in a substantially U shape. The movable stage 70 further includes bulged portions 72*a* bulged from the both side wall portions 72. The movable stage 70 is elastically supported by the X-axis direction elastic support mechanism 62 having an elastic member 64 so as to be movable in the X-axis direction with respect to the base member 65. Elastic movement refers to movement of a part of an elastic support mechanism accompanied by elastic deformation of an elastic member incorporated in the elastic support mechanism. The movement restriction device 94 that controls prohibition and permission of elastic movement of the movable stage 70 in at least the X-axis direction is provided between the guide rail 66A and the movable stage 70. For example, the movement restriction device 94 may be a brake device, and the control device 80 may output a control signal to the movement restriction device 94 to control the movement restriction device 94 to a prohibited state (brake engaged state) and a permitted state (brake disengaged state).

The Z-axis direction slide body 74 is elastically supported by the Z-axis direction elastic support mechanism 73 having a Z-axis direction return spring 90 so as to be elastically movable in the Z-axis direction with respect to the movable stage 70. The truing spindle holder 75 which houses the truing spindle 76 supported so as to be rotatable about the truer rotational axis L3 or the truing spindle 76 driven by a motor or the like to rotate about the truer rotational axis L3 is attached to the Z-axis direction slide body 74. The truer 77 (which corresponds to the truing device according to the present invention) of a generally cylindrical shape which perform truing of a surface of the grinding wheel 32 is attached to one end portion of the truing spindle 76. A truing surface 77*a* is formed on the outer periphery of the truer 77. The truing surface 77*a* is formed to have a recessed curved surface with an circular arc profile when seen in section including the axis. The truing surface 77*a* grinds the surface of the grinding wheel 32.

Figure 5:
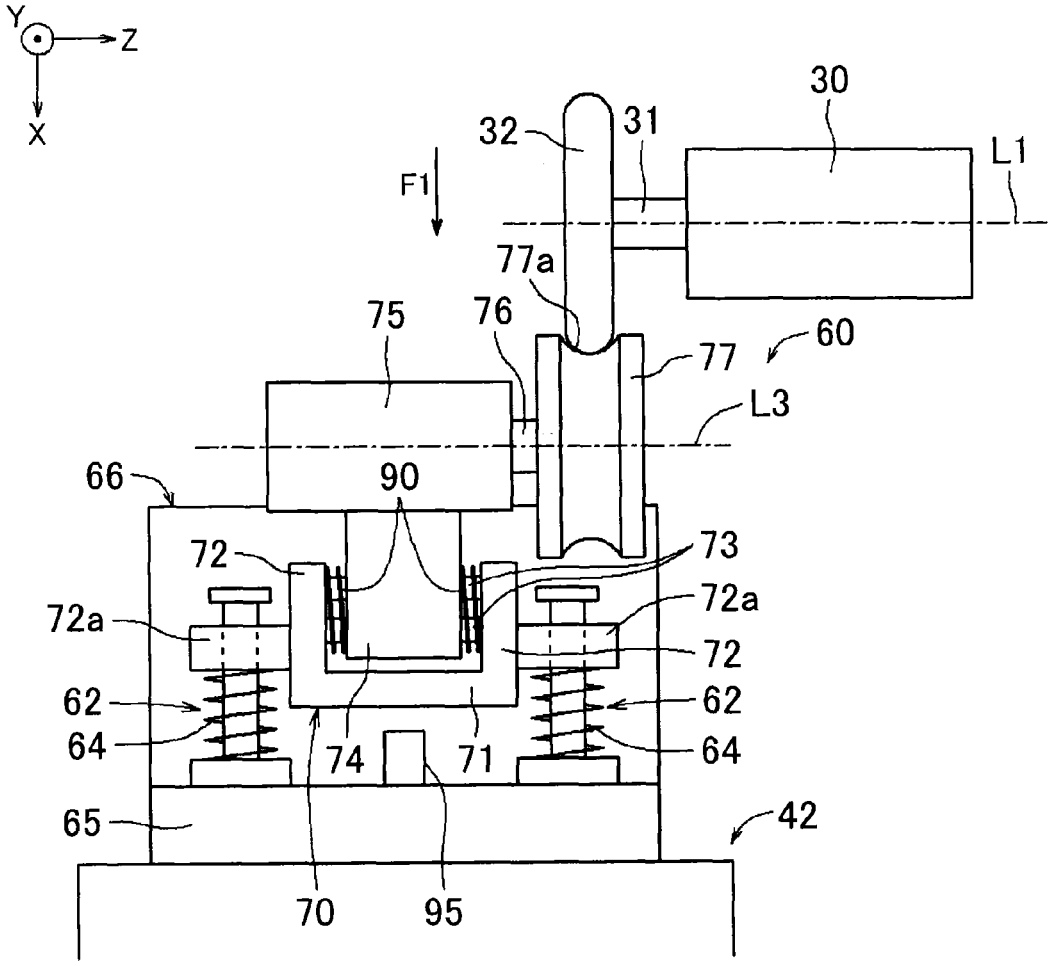
FIG. 5 is a plan view of the truing device and the grinding wheel, illustrating a state in which the grinding wheel contacts the truer and elastically move the truer in the X-axis direction.
Figure 6:
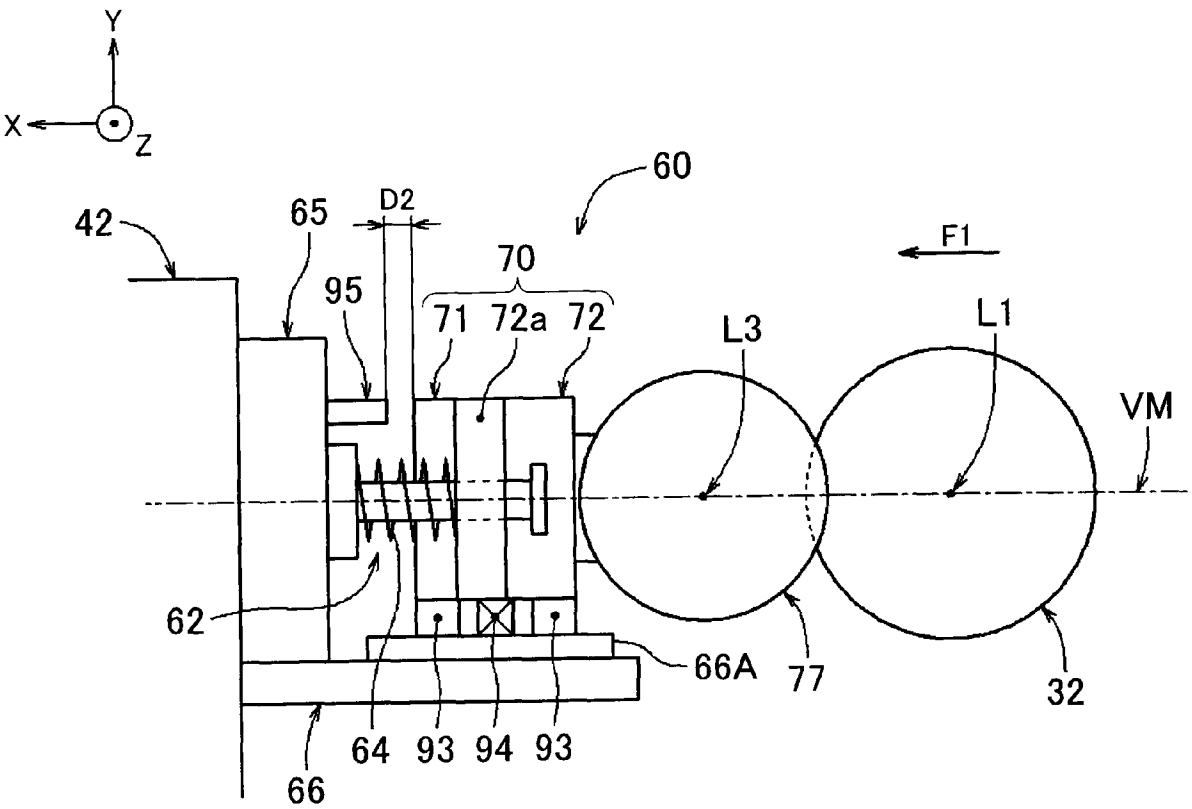
FIG. 6 is a side view of the state illustrated in FIG. 5.

The X-axis elastic movement amount detector 95 is installed between the movable stage 70 and the base member 65 to detect the amount of elastic movement of the movable stage 70 in the X-axis direction. In the plan view illustrated in FIG. 3 and the side view illustrated in FIG. 4, the truer 77 and the grinding wheel 32 are spaced from each other in the X-axis direction. In FIG. 4, it is indicated that the distance to the movable stage 70 in the X-axis direction detected by the X-axis elastic movement amount detector 95 is a distance D1. In the plan view illustrated in FIG. 5 and the side view illustrated in FIG. 6, the truer 77 and the grinding wheel 32 contact each other in the X-axis direction to cause the grinding wheel 32 to further cut into the truer 77 in the X-axis direction. FIGS. 5 and 6 illustrate a state in which the grinding wheel 32 pushes the truer 77 with a force F1 to elastically move the movable stage 70 in the X-axis direction. In FIG. 6, it is indicated that the distance to the movable stage 70 in the X-axis direction detected by the X-axis elastic movement amount detector 95 is a distance D2 (distance D1>distance D2). In this case, the control device 80 can calculate the amount of elastic movement of the movable stage 70 in the X-axis direction as the distance D1 minus the distance D2 on the basis of the detection signal from the X-axis elastic movement amount detector 95.

Figure 7A:
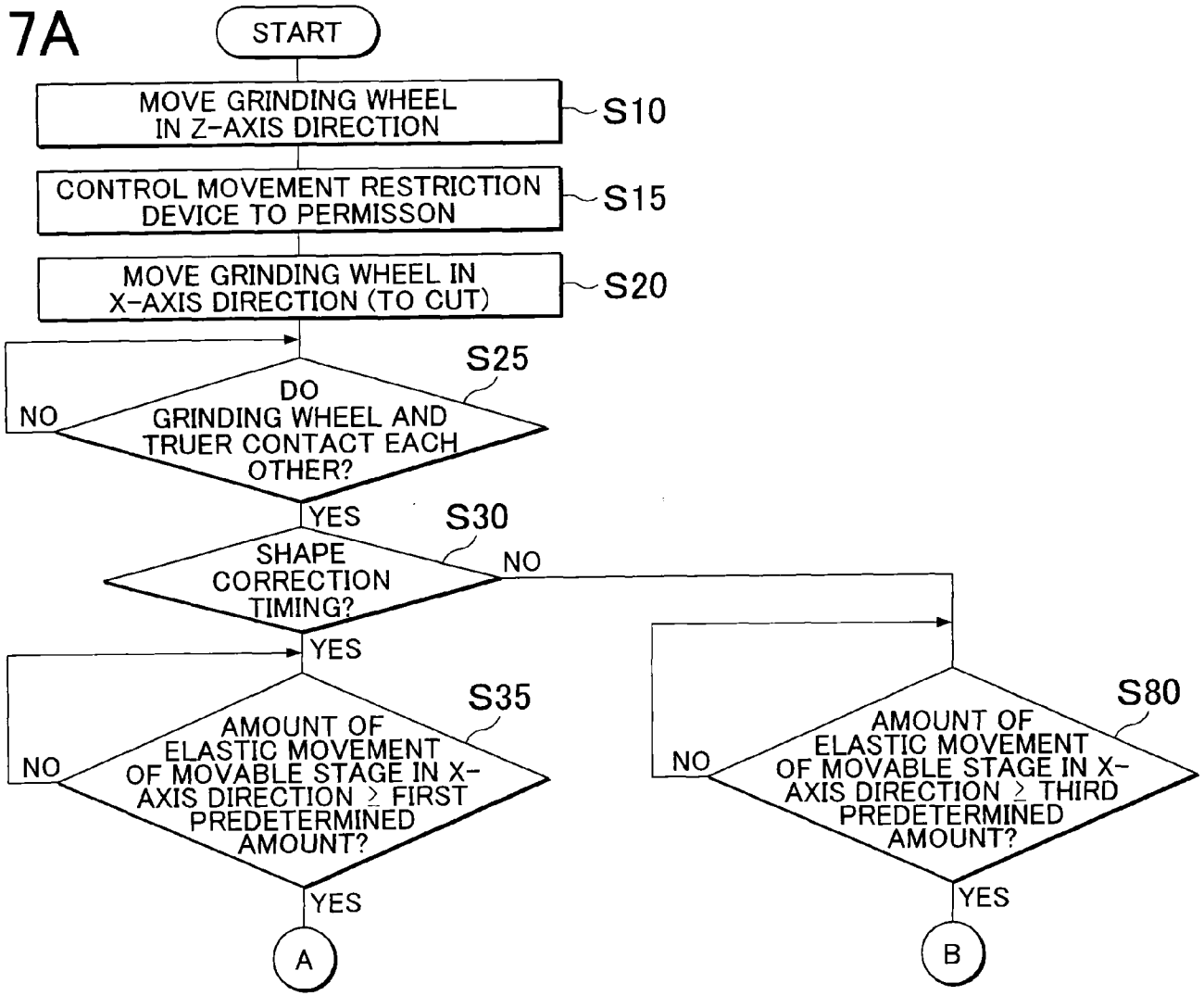
FIGS. 7A-7B are a flowchart illustrating the process procedure of truing.
Figure 7B:
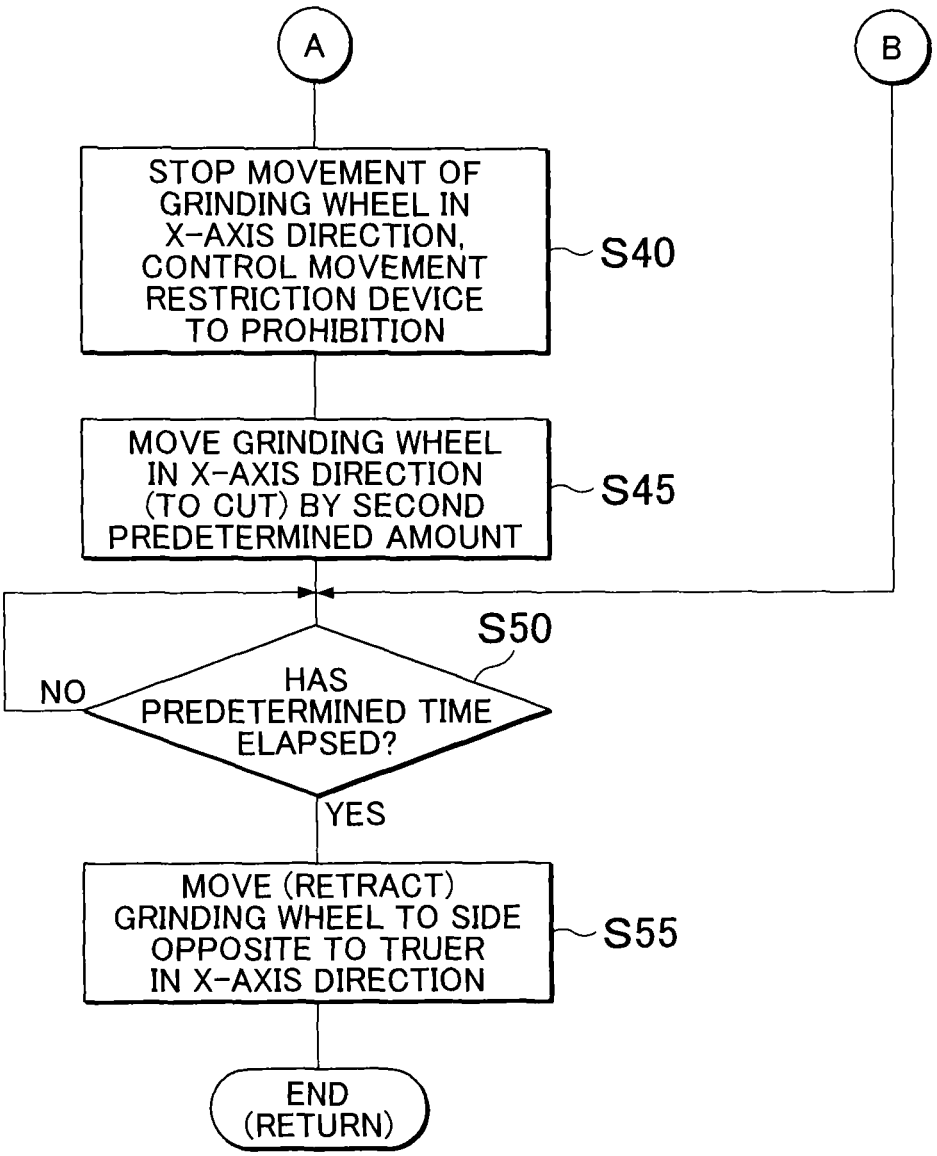

Next, an example of the process procedure of truing performed by the control device will be described with reference to the flowchart illustrated in FIGS. 7A-7B. The control device executes the process illustrated in FIGS. 7A-7B in the case where execution of truing is commanded, in the case where a truing timing set in advance has come, or the like.

In step S10, the control device starts driving rotation of the grinding wheel 32, and thereafter moves the grinding wheel 32 in the Z-axis direction. The process proceeds to step S15. The grinding wheel 32 is moved in the Z-axis direction by controlling the Z-axis direction driving motor, while the position of the grinding wheel 32 in the Z-axis direction is checked that is based on the detection signal from the Z-axis direction position detector 15, such that the position of the surface to be processed of the grinding wheel 32 in the Z-axis direction and the position of the truing surface 77*a* of the truer 77 in the Z-axis direction coincide with each other, that is, such that a portion of the surface to be processed of the grinding wheel with the largest diameter faces a portion of the truing surface with the smallest diameter in the X-axis direction. The truer 77 is also elastically supported in the Z-axis direction. Thus, there may be some deviation between the position of the surface to be processed of the grinding wheel 32 in the Z-axis direction and the position of the truing surface 77*a* of the truer 77 in the Z-axis direction. Therefore, there is no need for a Z-axis direction detection pin such as that according to the related art, and even if there is some error in position of the grinding wheel 32 in the Z-axis direction due to thermal displacement, such an error can be absorbed through elastic movement of the truer 77 in the Z-axis direction.

In step S15, the control device outputs a control signal to the movement restriction device to control the movement restriction device to a permitted state (in which elastic movement of the movable stage 70 in the X-axis direction is permitted). The process proceeds to step S20. In step S20, the control device controls the X-axis direction driving motor so as to gradually move the grinding wheel 32 toward the truer 77 in the X-axis direction (in the cutting direction) while checking the position of the grinding wheel 32 in the X-axis direction based on the detection signal from the X-axis direction position detector 25. The process proceeds to step S25. In step S25, the control device determines whether or not the grinding wheel 32 (the surface to be processed of the grinding wheel 32) and the truer 77 contact each other. In the case where the grinding wheel 32 and the truer 77 contact each other (Yes), the process proceeds to step S30. Otherwise, the process returns to step S25. The control device can detect whether or not the grinding wheel 32 (the surface to be processed of the grinding wheel 32) and the truer 77 contact each other in the X-axis direction on the basis of the detection signal from the X-axis elastic movement amount detector 95, for example. The processes in steps S10 to S25 correspond to step (a) (the grinding wheel contact step) according to the present invention, in which the control device relatively moves the grinding wheel with respect to the truer in the Z-axis direction to cause the truing device and the grinding wheel to face each other in the X-axis direction, controls the movement restriction device to the permitted state, and relatively moves the grinding wheel with respect to the truer in the X-axis direction to cause the surface to be processed of the grinding wheel to contact the truer.

In the case where the process proceeds to step S30, the control device determines whether or not the current truing is based on a grinding wheel shape correction timing. In the case where it is determined that the current truing is based on the shape correction timing (Yes), the process proceeds to step S35. Otherwise (No) (that is, in the case where the current truing is based on a surface roughness correction timing), the process proceeds to step S80. The surface roughness correction timing and the shape correction timing may be set such that surface roughness correction is started each time a first predetermined number of workpieces W are processed, and such that shape correction is performed each time a second predetermined number of workpieces W are processed (second predetermined number>first predetermined number). Only shape correction may be performed in the case where the shape correction timing and the surface roughness correction timing coincide with each other.

In the case where the process proceeds to step S35, the control device determines on the basis of the detection signal from the X-axis elastic movement amount detector whether or not the amount of elastic movement of the truer 77 in the X-axis direction (the amount of elastic movement calculated as the distance D1 minus the distance D2 using the distance D1 indicated in FIG. 4 and the distance D2 indicated in FIG. 6) is equal to or more than a first predetermined amount. In the case where the elastic movement amount is equal to or more than the first predetermined amount (Yes), the process proceeds to step S40. Otherwise (No), the process returns to step S35.

In the case where the process proceeds to step S40, the control device stops movement of the grinding wheel 32 in the X-axis direction (cutting in the X-axis direction in step S20), and outputs a control signal to the movement restriction device to control the movement restriction device to the prohibited state (in which elastic movement of the movable stage 70 in the X-axis direction is prohibited). The process proceeds to step S45. In step S45, the control device controls the X-axis direction driving motor so as to further move the grinding wheel 32 toward the truer 77 (cause the grinding wheel 32 to cut into the truer 77) in the X-axis direction by a second predetermined amount to shape (refine the shape of) the grinding wheel 32 while checking the position of the grinding wheel 32 in the X-axis direction based on the detection signal from the X-axis direction position detector 25. The process proceeds to step S50. The processes in steps S35 to S45 correspond to step (b) (the grinding wheel shape correction step), in which when the grinding wheel and the truer contact each other (in the case where the first predetermined amount is substantially zero), or when the grinding wheel relatively cuts into the truing device in the X-axis direction until the amount of elastic movement of the truer in the X-axis direction reaches the first predetermined amount after the grinding wheel and the truer contact each other, the control device controls the movement restriction device to the prohibited state so as to prohibit elastic movement of the truer in at least the X-axis direction, and thereafter the grinding wheel is caused to further relatively cut into the truer in the X-axis direction by the second predetermined amount to correct the shape of the grinding wheel.

In the case where the process proceeds to step S50, the control device measures the time elapsed since step S50 started to determine whether or not a predetermined time has elapsed. In the case where the predetermined time has elapsed (Yes), the process proceeds to step S55. Otherwise (No), the process returns to step S50. In the case where the process proceeds to step S55, the control device controls the X-axis direction driving motor so as to move the grinding wheel 32 to the side opposite to the truer 77 to space the grinding wheel 32 and the truer 77 from each other in the X-axis direction while checking the position of the grinding wheel 32 in the X-axis direction based on the detection signal from the X-axis direction position detector 25. The truing process is ended.

In the case where the process proceeds to step S80, the control device determines on the basis of the detection signal from the X-axis elastic movement amount detector whether or not the amount of elastic movement of the truer 77 in the X-axis direction (the amount of elastic movement calculated as the distance D1 minus the distance D2 using the distance D1 indicated in FIG. 4 and the distance D2 indicated in FIG. 6) is equal to or more than a third predetermined amount. In the case where the elastic movement amount is equal to or more than the third predetermined amount (Yes), the process proceeds to step S50. Otherwise (No), the process returns to step S80. The third predetermined amount is larger than the first predetermined amount. Step S80 corresponds to the grinding wheel surface roughness correction step, in which in the case where it is determined that the truing is based on the surface roughness correction timing (that is, it is determined that the truing is not based on the shape correction timing), the surface roughness of the grinding wheel is corrected by causing the grinding wheel to relatively cut into the truer in the X-axis direction until the amount of elastic movement of the truer in the X-axis direction after contact between the grinding wheel and the truer reaches the third predetermined amount which is larger than the first predetermined amount. The processes in steps S50 and S55 have already been described, and thus are not described here.

Figure 8:
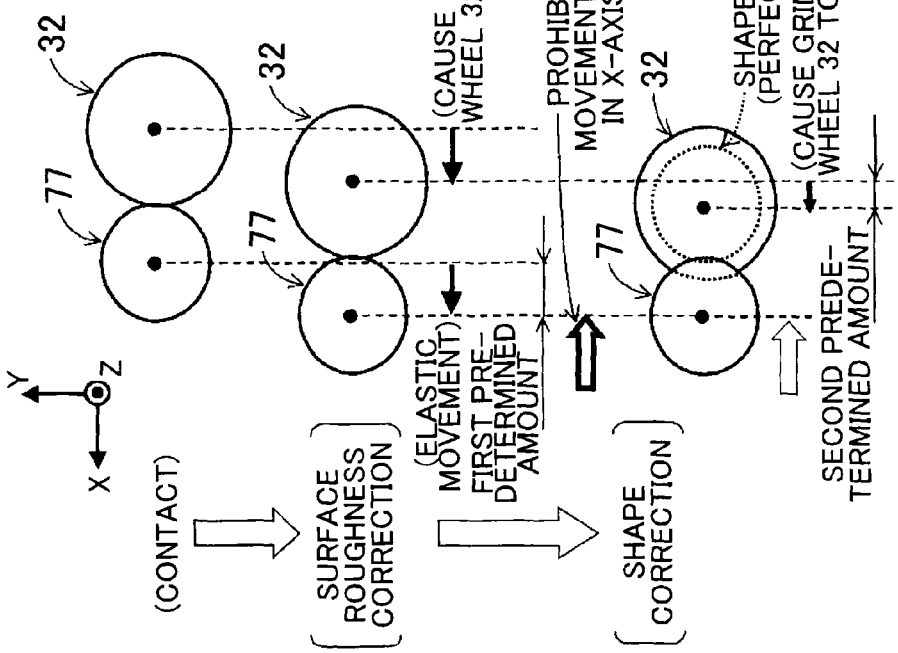
FIG. 8 illustrates motion of the grinding wheel and the truer in a grinding wheel shape correction step and a grinding wheel surface roughness correction step in the case where a first predetermined amount is not zero.
Figure 8:
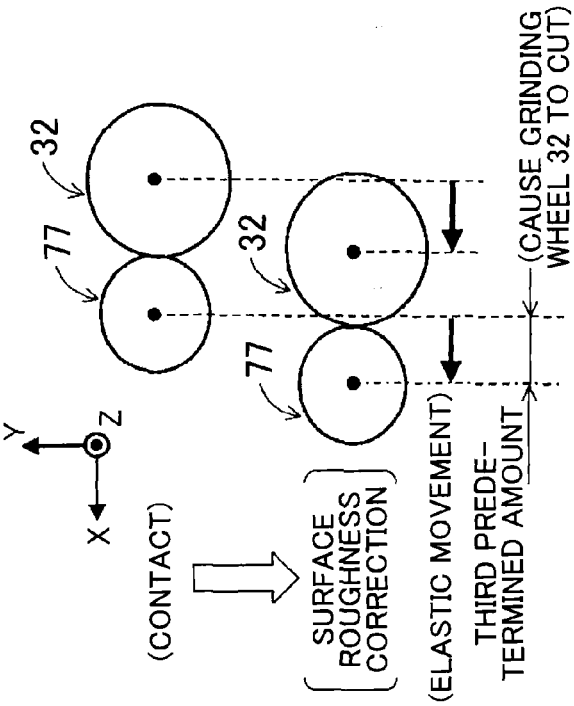
Figure 9:
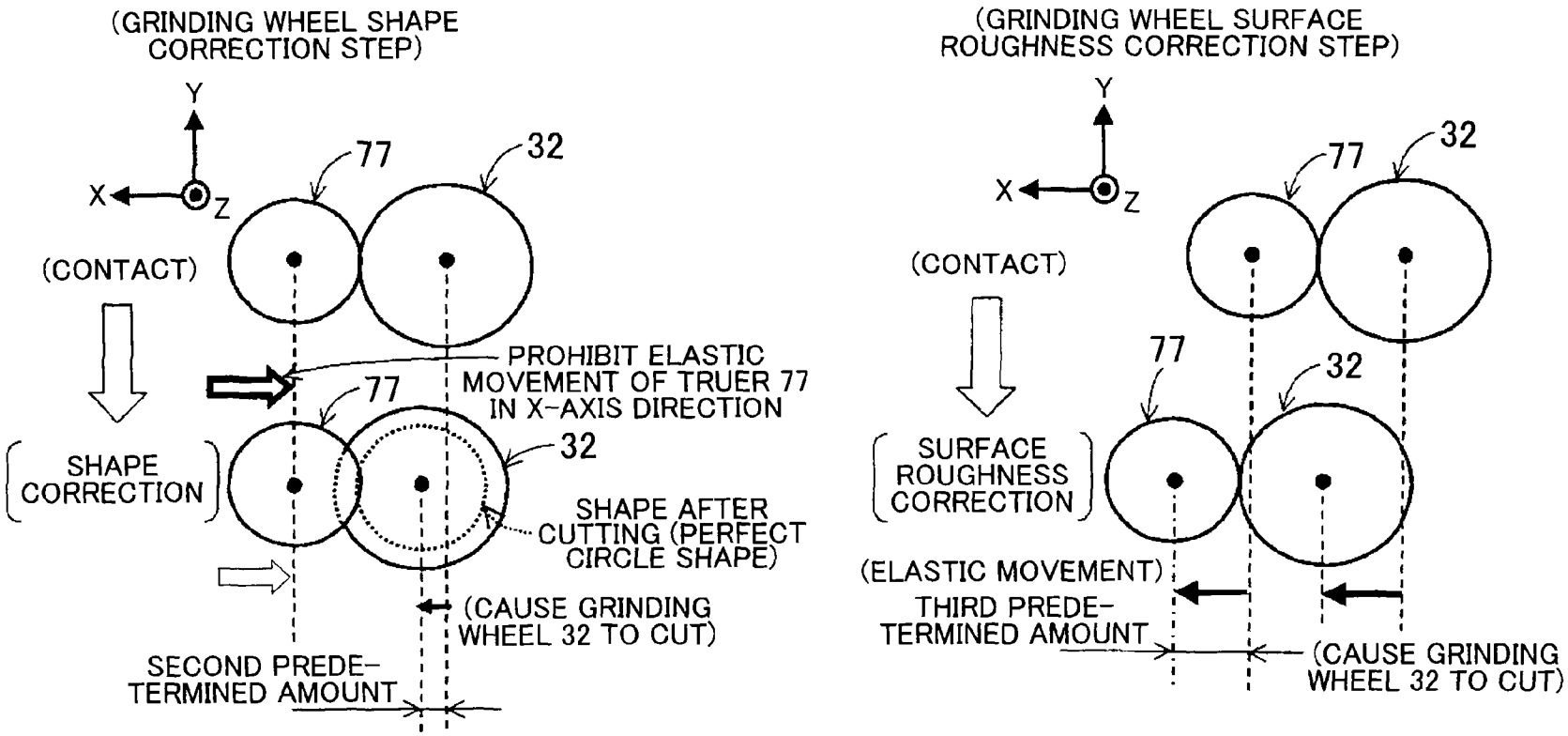
FIG. 9 illustrates motion of the grinding wheel and the truer in the grinding wheel shape correction step and the grinding wheel surface roughness correction step in the case where the first predetermined amount is substantially zero.

FIG. 8 illustrates operation in the grinding wheel shape correction step (operation executed in steps S25, S30, S35, S40, and S45) and operation in the grinding wheel surface roughness correction step (operation executed in steps S25, S30, and S80) in the case where the first predetermined amount is not zero in step S35. FIG. 9 illustrates operation in the grinding wheel shape correction step (operation executed in steps S25, S30, S35, S40, and S45) and operation in the grinding wheel surface roughness correction step (operation executed in steps S25, S30, and S80) in the case where the first predetermined amount is substantially zero in step S35. In FIGS. 8 and 9, for ease of understanding, the first predetermined amount, the second predetermined amount, and the third predetermined amount are depicted as significantly exaggerated compared to the actual values (e.g. several micrometers to several hundreds of micrometers).

As described above, in both cases of FIGS. 8 and 9, in the grinding wheel shape correction step, the grinding wheel 32 cuts into the truer 77, which is prohibited from making elastic movement in the X-axis direction, by the second predetermined amount to execute truing of itself. Thus, even if the grinding wheel 32 has run-out (an error in peripheral shape from a perfect circle shape), such run-out can be appropriately eliminated and the grinding wheel 32 can be reshaped into a perfect circle shape. In the grinding wheel surface roughness correction step, the grinding wheel 32 cuts into the truer 77 in the X-axis direction until the truer 77, which is permitted to make elastic movement in the X-axis direction, is elastically moved by the third predetermined amount, to execute truing of itself. Thus, the surface of the grinding wheel 32 can be ground by an appropriate thickness to dress the grinding wheel and unnecessarily grinding of the surface of the grinding wheel 32 can be avoided. Thus, the life of the grinding wheel can be extended. The provision of the movement restriction device eliminates the need to separately provide a truer that is elastically movable in the X-axis direction and a truer that is not elastically movable in the X-axis direction. Thus, the grinding machine can be made simpler and more compact in configuration, and truing can be completed in a short time compared to a case where separate truers are provided. The truer 77 is also elastically movable in the Z-axis direction. Thus, it is convenient that the truer 77 is automatically and elastically moved to a correct position in the Z-axis direction even if there is some deviation in position of the grinding wheel 32 with respect to the truer 77 in the Z-axis direction.

In the description of the embodiment, the grinding wheel is moved with respect to the truer in the X-axis direction and the Z-axis direction. However, the truer may be relatively moved with respect to the grinding wheel in the X-axis direction and the Z-axis direction. In the description of the embodiment, the movement restriction device controls permission and prohibition of elastic movement of the truer in the X-axis direction. However, the movement restriction device may control permission and prohibition of elastic movement of the truer in the X-axis direction and the Z-axis direction. That is, the movement restriction device may control permission and prohibition of elastic movement of the truer in at least the X-axis direction.

What is claimed is:

1. A grinding wheel truing method comprising:

(a) by a control device, causing a surface of a grinding wheel to contact a truing device by moving the grinding wheel with respect to the truing device in a Z-axis direction to cause the truing device and the grinding wheel to face each other in a X-axis direction, and then controlling a movement restriction device to a permitted state so as to relatively move the grinding wheel with respect to the truing device in the X-axis direction; and (b) by the control device, correcting a shape of the grinding wheel, when the grinding wheel and the truing device contact each other, or when the grinding wheel relatively cuts into the truing device in the X-axis direction until an amount of elastic movement of the truing device in a X-axis direction reaches a first predetermined amount after the grinding wheel and the truing device contact each other, by controlling the movement restriction device to a prohibited state so as to prohibit elastic movement of the truing device in at least the X-axis direction, and thereafter causing the grinding wheel to further relatively cut into the truing device in the X-axis direction by a second predetermined amount, wherein, the grinding wheel truing method is performed using:

the grinding wheel having a generally cylindrical shape and driven to rotate about a grinding wheel rotational axis;

the truing device supported so as to be rotatable about a truer rotational axis that is parallel to the Z-axis direction that is parallel to the grinding wheel rotational axis, or supported so as to be driven to rotate about the truer rotational axis, to execute truing of the grinding wheel; and the control device that relatively moves the grinding wheel with respect to the truing device in the X-axis direction and the Z-axis direction, the X-axis direction being a direction that is orthogonal to the grinding wheel rotational axis and in which the grinding wheel cuts into the truing device, the truing device being elastically supported in the Z-axis direction to be elastically movable in the Z-axis direction, being elastically supported in the X-axis direction to be elastically movable in the X-axis direction, and including a movement restriction device that controls prohibition and permission of elastic movement in at least the X-axis direction.

2. The grinding wheel truing method according to claim 1, wherein:

after step (a) and before step (b) the control device determines on the basis of a predetermined determination condition whether current truing is based on a shape correction timing for correcting the shape of the grinding wheel or based on a surface roughness correction timing for correcting a surface roughness of the grinding wheel;

in the case where it is determined that the current truing is based on the shape correction timing, step (b) is executed; and in the case where it is determined that the current truing is based on the surface roughness correction timing, the surface roughness of the grinding wheel is corrected by causing the grinding wheel to relatively cut into the truing device in the X-axis direction until the amount of elastic movement of the truing device in the X-axis direction after contact between the grinding wheel and the truing device reaches a third predetermined amount that is larger than the first predetermined amount.

3. A grinding machine that execute truing of a grinding wheel by the grinding wheel truing method according to claim 1, comprising:

an X-axis direction movement device that relatively moves the grinding wheel with respect to the truing device in the X-axis direction;

an X-axis relative movement amount detector capable of detecting an amount of relative movement of the grinding wheel with respect to the truing device in the X-axis direction caused by the X-axis direction movement device;

a Z-axis direction movement device that relatively moves the grinding wheel with respect to the truing device in the Z-axis direction;

a Z-axis relative movement amount detector capable of detecting an amount of relative movement of the grinding wheel with respect to the truing device in the Z-axis direction caused by the Z-axis direction movement device;

an X-axis elastic movement amount detector capable of detecting an amount of elastic movement of the truing device in the X-axis direction;

the movement restriction device that controls prohibition and permission of elastic movement of the truing device in at least the X-axis direction; and the control device that receives detection signals from the X-axis relative movement amount detector, the Z-axis relative movement amount detector, and the X-axis elastic movement amount detector to control the X-axis direction movement device, the Z-axis direction movement device, and the movement restriction device.

4. A grinding machine that execute truing of a grinding wheel by the grinding wheel truing method according to claim 2, comprising:

an X-axis direction movement device that relatively moves the grinding wheel with respect to the truing device in the X-axis direction;

an X-axis relative movement amount detector capable of detecting an amount of relative movement of the grinding wheel with respect to the truing device in the X-axis direction caused by the X-axis direction movement device;

a Z-axis direction movement device that relatively moves the grinding wheel with respect to the truing device in the Z-axis direction;

a Z-axis relative movement amount detector capable of detecting an amount of relative movement of the grinding wheel with respect to the truing device in the Z-axis direction caused by the Z-axis direction movement device;

an X-axis elastic movement amount detector capable of detecting an amount of elastic movement of the truing device in the X-axis direction;

the movement restriction device that controls prohibition and permission of elastic movement of the truing device in at least the X-axis direction; and the control device that receives detection signals from the X-axis relative movement amount detector, the Z-axis relative movement amount detector, and the X-axis elastic movement amount detector to control the X-axis direction movement device, the Z-axis direction movement device, and the movement restriction device.

* * * * *